US008152331B1

(12) United States Patent
Barton et al.

(10) Patent No.: US 8,152,331 B1
(45) Date of Patent: Apr. 10, 2012

(54) LINEAR LIGHTING FIXTURE WITH TELESCOPING HOUSING

(75) Inventors: Dan Barton, Huntington Beach, CA (US); Brad Barton, Huntington Beach, CA (US)

(73) Assignee: Reled Systems LLC, Huntington Beach, CA (US)

( * ) Notice: Subject to any disclaimer, the term of this patent is extended or adjusted under 35 U.S.C. 154(b) by 303 days.

(21) Appl. No.: 12/510,137

(22) Filed: Jul. 27, 2009

(51) Int. Cl.
*F21V 15/01* (2006.01)
*F21V 21/005* (2006.01)
*F21S 4/00* (2006.01)

(52) U.S. Cl. ..... 362/220; 362/217.1; 362/217.14; 362/366; 362/418

(58) Field of Classification Search ..... 362/220, 362/217.1, 217.11, 217.14–217.17, 285, 362/362, 366, 410–426
See application file for complete search history.

(56) References Cited

U.S. PATENT DOCUMENTS 1,699,519 A * 1/1929 Brown ..... 227/147
2,218,825 A * 10/1940 Le Guillou ..... 294/19.2
2,408,783 A * 10/1946 Kloner ..... 362/219
2,532,023 A * 11/1950 Guth, Jr. ..... 362/220
2,588,144 A * 3/1952 Mided et al. ..... 362/220
2,623,329 A * 12/1952 Di Leva ..... 446/320
3,673,402 A * 6/1972 Weiss ..... 362/220
3,792,247 A 2/1974 Beuttell
4,070,571 A * 1/1978 Robertson et al. ..... 362/217.08
4,455,594 A * 6/1984 Yang ..... 362/220
5,624,178 A 4/1997 Lee, Jr.
7,036,955 B2 * 5/2006 Kazi et al. ..... 362/219
7,234,832 B2 * 6/2007 Lippis et al. ..... 362/147
7,413,323 B2 8/2008 Lippis et al.
7,611,117 B1 * 11/2009 Lang, Jr. ..... 248/452

* cited by examiner

*Primary Examiner* — Ismael Negron
(74) *Attorney, Agent, or Firm* — Cislo & Thomas, LLP

(57) ABSTRACT

An expandable fixture for various linear lamp lengths that includes telescoping segments and a lamp connector connected to one or more of the telescoping segments. The telescoping segments defines a longitudinal axis and includes at least two segments slidably engaged with each other. In this way, the length of the expandable fixture may be increased and decreased along the longitudinal axis of the expandable fixture. The expandable fixture may include a mechanism to lock the expandable fixture at the adjusted length. In a typical version, the expandable fixture may have a length of about forty-eight (48) inches when fully extended and about twenty-four (24) inches when fully contracted, with the electrical ballast being housed within the fixture.

18 Claims, 5 Drawing Sheets

LINEAR LIGHTING FIXTURE WITH TELESCOPING HOUSING

TECHNICAL FIELD

This invention relates to length-adjustable light fixtures, especially such fixtures for fluorescent lighting.

BACKGROUND ART

Linear fluorescent lights are prolific. Even so, each different lamp type and length requires its own specific fixture. As a result, retailers and builders must stock a variety of sizes to cover the various applications.

What is needed, therefore, is an adjustable linear light fixture that extends and contracts for the purposes of fitting different light source links and types. The expandable fixture disclosed here fills that need. During installation if a different length fixture is needed, the installer can simply expand or contract the expandable fixture rather than having to purchase another fixed-length fixture. The devise also reduces inventory by removing the need to have several standard fixture lengths on hand. Also, in its contracted configuration the expandable fixture saves valuable retail space by minimizing the shelf space required to display the product.

DISCLOSURE OF INVENTION

The present invention is directed to an expandable fixture for various linear lamp lengths. The expandable fixture includes telescoping segments and a lamp connector connected to one or more of the telescoping segments.

The telescoping segments define a longitudinal axis and, in a version of the invention, include a first end segment, a central segment, and a first intermediate segment. The first end segment is slidably engaged with the first intermediate segment, and the first intermediate segment is slidably engaged with the central segment. In this way, the length of the expandable fixture may be increased and decreased along the longitudinal axis of the expandable fixture.

The expandable fixture may also include a mechanism to lock the expandable fixture at the adjusted length. In a typical version, the expandable fixture may have a length of about forty-eight (48) inches when fully extended and about twenty-four (24) inches when fully contracted, with the electrical ballast being housed within the fixture.

BEST MODE FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

By reference to the figures, an expandable fixture 100 for a plurality of linear lamp lengths includes telescoping or nested segments 102 and a lamp connector 104 connected to one or more of the telescoping segments 102.

Figure 1:
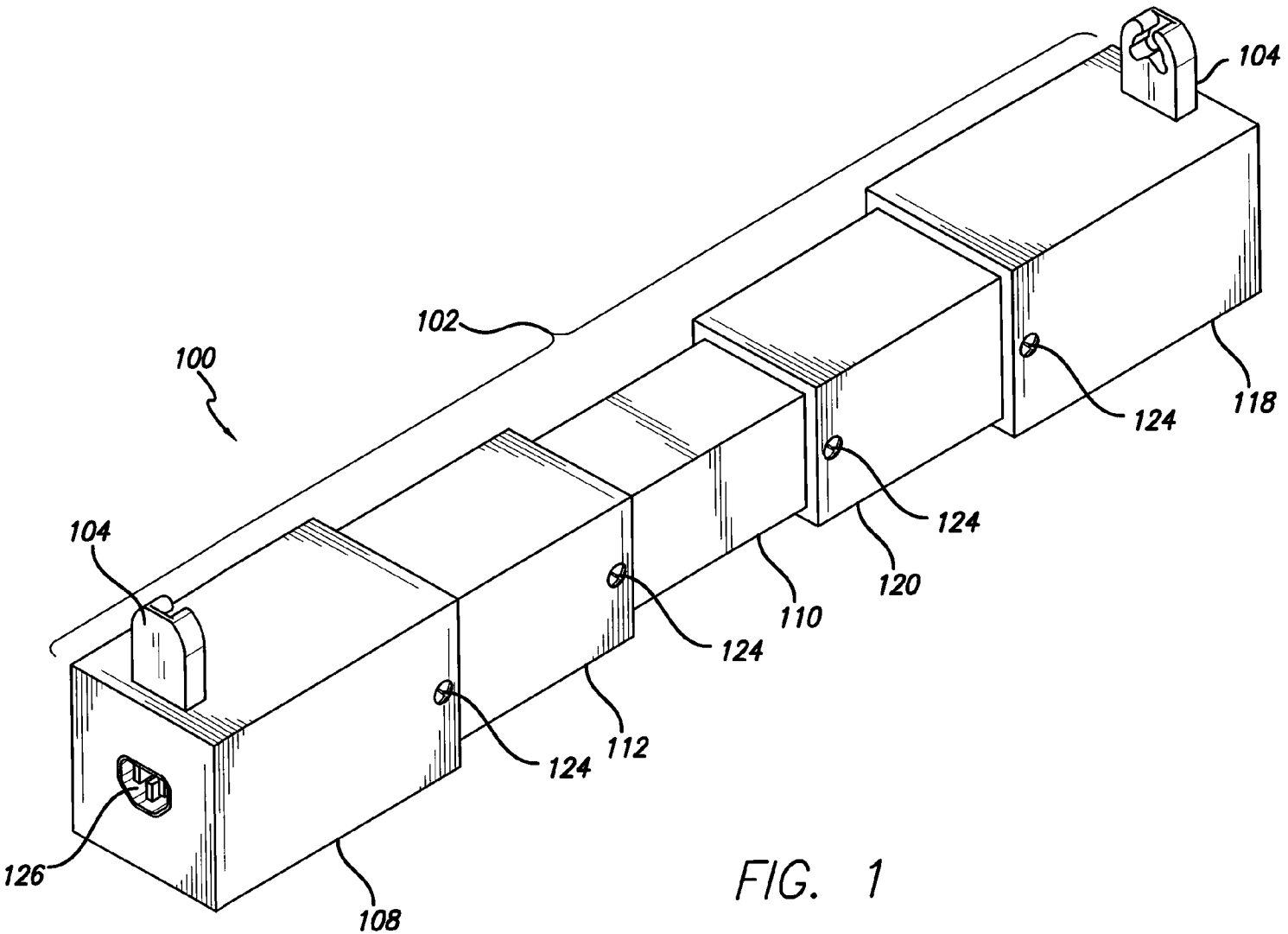
FIG. 1 is a perspective view of an embodiment of an Expandable Linear Lighting Fixture shown in a partially extended condition.

The telescoping segments 102 define a longitudinal axis 106 of the expandable fixture 100. In the embodiment shown in FIG. 1, the telescoping segments 102 have a first end segment 108, a central segment 110, and a first intermediate segment 112. The first end segment 108 is slidably engaged with the first intermediate segment 112, and the first intermediate segment 112 is slidably engaged with the central segment 110. In this way, the length of the expandable fixture 100 may be increased and decreased along the longitudinal axis 106 of the expandable fixture 100.

Figure 7:
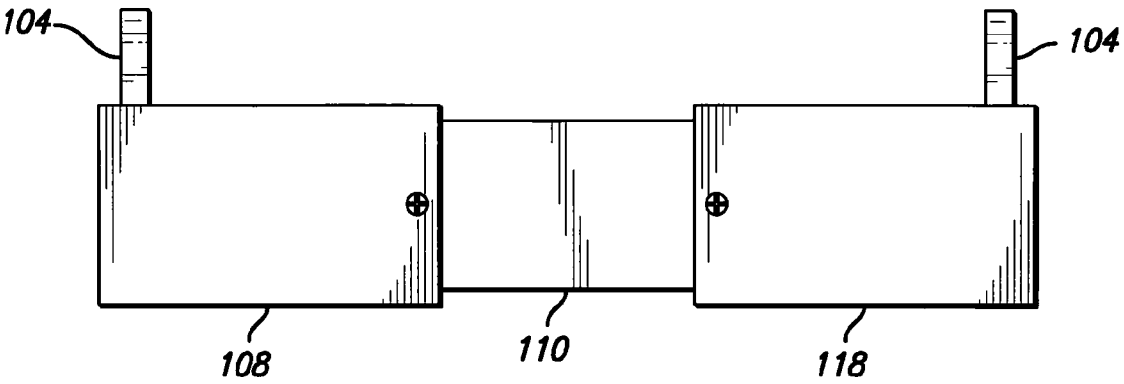
FIG. 7 is a front view of an embodiment of an Expandable Linear Lighting Fixture having no intermediate segments.
Figure 8:
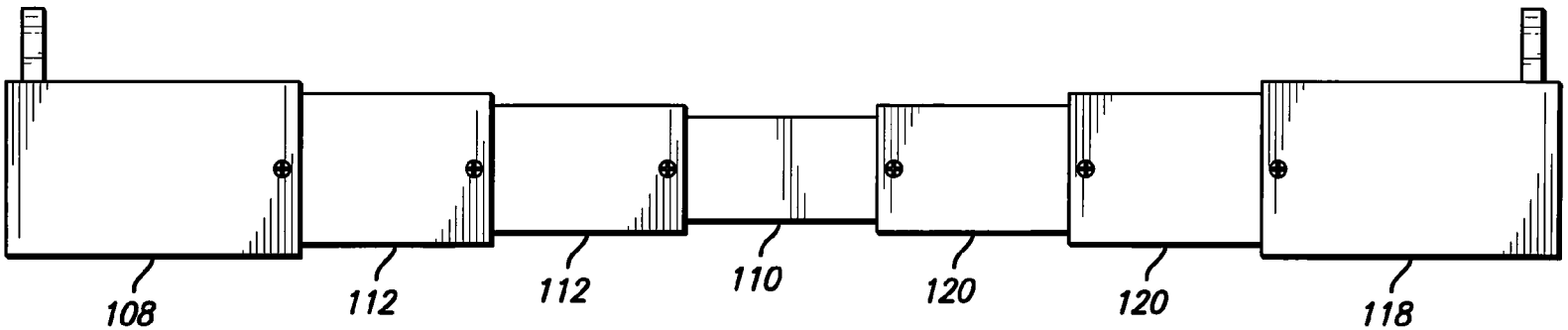
FIG. 8 is a front view of an embodiment of an Expandable Linear Lighting Fixture having multiple intermediate segments.

Preferably, the first intermediate segment 112 slides within the first end segment 108, and the central segment 110 slides within the first intermediate segment 112. Depending on the length and configuration desired, in some embodiments there is no first intermediate segment 112; so the first end segment 108 is slidably engaged with the central segment 110. Such a version is shown in FIG. 7. Likewise, there could be more than one first intermediate segment 112, slidably engaged to the adjacent first intermediate segment 112. Such a version is shown in FIG. 8.

In a version of the invention, the telescoping segments 102 also include a second end segment 118 and a second intermediate segment 120. The central segment 110 is slidably engaged with the second intermediate segment 120, and the second intermediate segment 120 is slidably engaged with the second end segment 118. In such versions, the central segment 110 preferably slides within the second intermediate segment 120, and the second intermediate segment 120 preferably slides within the second end segment 118. Depending on the length and configuration desired, in some embodiments there is no second intermediate segment 120; so the second end segment 118 is slidably engaged with the central segment 110. Refer to FIG. 7. Likewise, there could be more than one second intermediate segment 120, slidably engaged to the adjacent second intermediate segment 120. Refer to FIG. 8.

Figure 2:
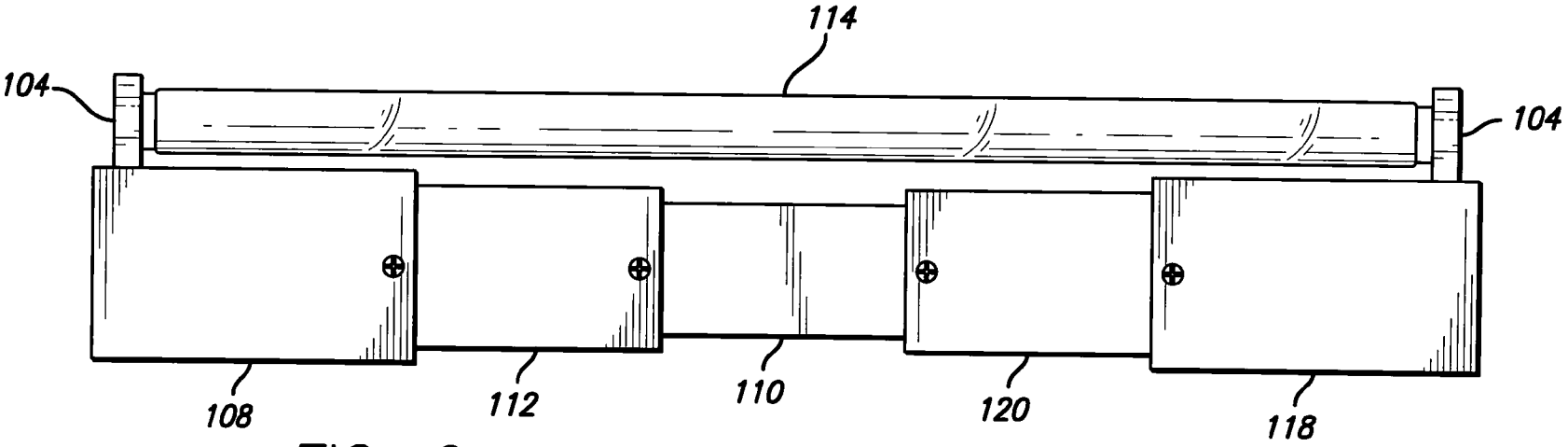
FIG. 2 is a front view of the embodiment of the Expandable Linear Lighting Fixture shown in FIG. 1 and also showing a lamp installed in the fixture.
Figure 3:
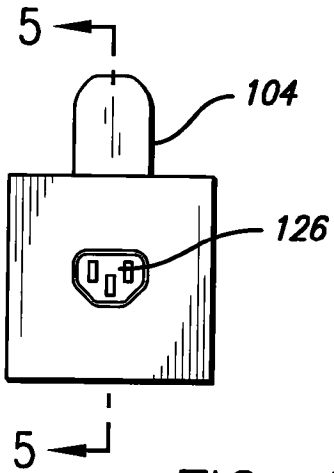
FIG. 3 is a right side view of the embodiment of the Expandable Linear Lighting Fixture shown in FIG. 1.
Figure 4:
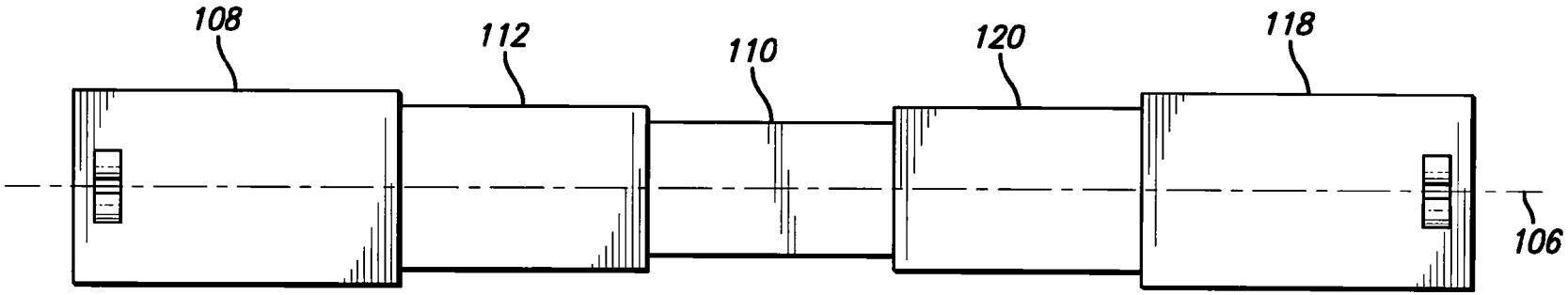
FIG. 4 is a top view of the embodiment of the Expandable Linear Lighting Fixture shown in FIG. 1.
Figure 6:
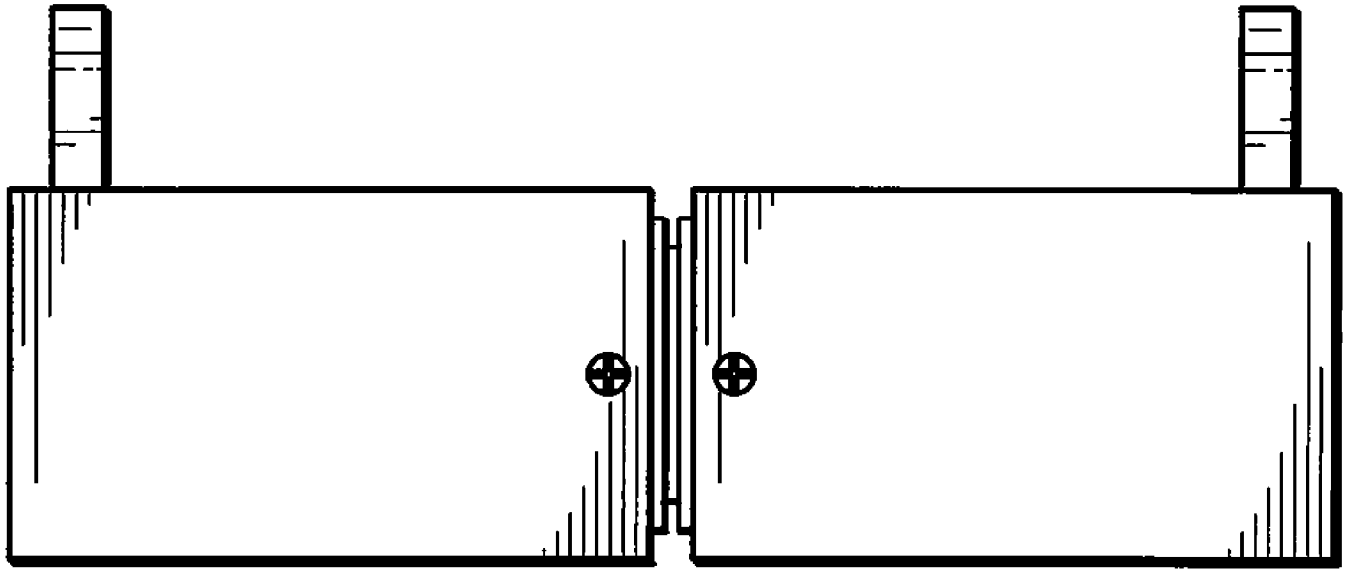
FIG. 6 is a front view of an Expandable Linear Lighting Fixture shown in an unextended condition.

In a typical version, the expandable fixture 100 may have a length of about forty-eight (48) inches when fully extended and about twenty-four (24) inches when fully contracted. FIG. 2 shows an intermediate, partial extension of the expandable fixture 100 and FIG. 6 shows the expandable fixture 100 being essentially contracted. In an embodiment of the invention, the expandable fixture 100 may include a locking mechanism 124, such as one or more setscrews, to lock the expandable fixture 100 at the adjusted length.

Figure 5:
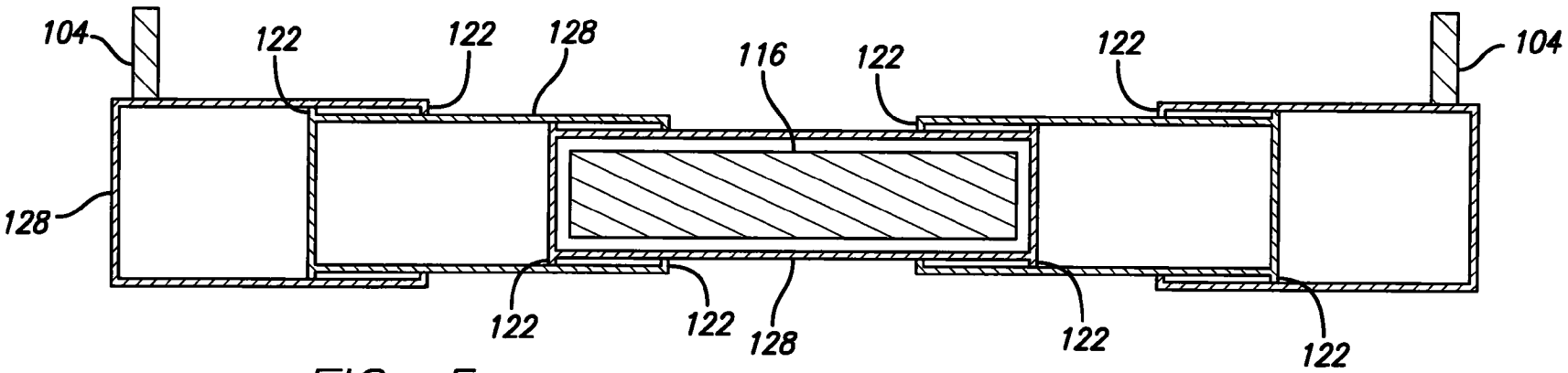
FIG. 5 is a sectional view of the front of the embodiment of the Expandable Linear Lighting Fixture shown in FIG. 1 and taken along the line 5-5 in FIG. 3.

The expandable fixture 100 also typically includes electrical ballast 116. The electrical ballast 116 is in electrical connection to the lamp connector 104 and provides a stable current for a selected lamp type or for a variety of lamp types. The electrical ballast 116, for example, could be an electronic ballast or a magnetic ballast, including "universal" ballast capable of regulating multiple lamp types (for example, lengths, diameters, and power ratings) in a single ballast unit. Electrical power may be supplied to the expandable fixture 100 through a power inlet 126, an example of which is shown in FIG. 5.

Preferably, the telescoping segments 102 are each rectangular in cross-section since that shape provides structural integrity by resisting bending and twisting. More preferably, the telescoping segments 102 each have a rectangular cross-section with a thin sidewall 128, for example as depicted in FIG. 5. The rectangular shape also permits the lamp's control electronics, such as the ballast 116 and wiring, to be located within the telescoping segments 102.

The lamp connector 104 is located to permit connection of a lamp 114 to the expandable fixture 100 in a direction parallel to the longitudinal axis 106 of the expandable fixture 100. For fluorescent lamp applications, the lamp connector 104 is typically a pair of lamp sockets having two-pin connectors, the pair of lamp sockets being generally positioned as shown in the figures. The expandable fixture 100 may also be used for installations having two or more linear lamps.

In some versions of the invention, the expandable fixture 100 also has a plurality of correlating stop flanges 122 to prevent the telescoping segments 102 from being disengaged from one another at the limits of extension of the telescoping segments 102. For example, the stop flanges may include a lip on each of the telescoping segments 102, where each lip engages a lip on another of the telescoping segments 102 when the expandable fixture 100 is fully extended. The stop flanges 122 may also assist the user to extend the expandable fixture 100 by translating the extending force to the other of the telescoping segments 102.

In operation, the expandable fixture 100 is preferably shipped in its fully contracted configuration to reduce shipping materials and freight costs. The user simply adjusts the expandable fixture 100 to the wanted length and, if included, engages the locking mechanism 124 to fix the length. The expandable fixture 100 can then be attached to whatever mounting surface is desired, if any, and the expandable fixture 100 can be connected to electrical power to operate a lamp 114 connected to the fixture. In this way, a single expandable fixture 100 can be used to fit a number of different lamp types. This is particularly beneficial where during installation the user realizes that a different length of fixture is needed than what was originally supposed. Moreover, the expandable fixture 100 reduces inventory by removing the need to have several standard fixture lengths on hand. Also, in its contracted configuration the expandable fixture 100 saves valuable retail space by minimizing the shelf space required to display the product.

While the present invention has been described with regards to particular embodiments, it is recognized that additional variations of the present invention may be devised without departing from the inventive concept. For example, it is contemplated that the telescoping segments 102 could be nested in the opposite fashion, such that the expandable fixture 100 collapses into the central segment 110 in the contracted configuration rather than one or both of the end segments 108, 118.

INDUSTRIAL APPLICABILITY

This invention may be industrially applied to the development, manufacture, and use of length adjustable light fixtures, especially such fixtures for fluorescent lighting.

What is claimed is:

1. An expandable fixture for a variety of lamp lengths, the expandable fixture comprising:

(a) telescoping segments defining a longitudinal axis of the expandable fixture, the telescoping segments having a closed, polygonal cross-section and comprising:

(i) a first end segment;

(ii) a central segment; and (iii) a second end segment;

where the first end segment is slidably engaged with the central segment, and the central segment is slidably engaged with the second end segment, each of the first end segment and the second end segment having a top surface, the top surface of the first end segment being equidistant from the longitudinal axis as the top surface of the second end segment; and (b) a lamp connector connected to the top surface of the first end segment or the top surface of the second end segment, the lamp connector located to permit connection of a lamp to the expandable fixture in a direction parallel to the longitudinal axis of the expandable fixture;

where the combination of the telescoping segments and the lamp connector provides a lamp fixture that is linearly expandable to accommodate a variety of lamp lengths.

2. The expandable fixture of claim 1, the telescoping segments each being thin-walled.

3. The expandable fixture of claim 1, the central segment sliding within the first end segment and the central segment sliding within the second end segment.

4. The expandable fixture of claim 1, the lamp connector being a pair of two-pin connectors to accommodate a linear fluorescent lamp.

5. The expandable fixture of claim 1, the lamp connector being more than one pair of two-pin connectors to accommodate more than one linear fluorescent lamp, where one linear fluorescent lamp is between each pair of two-pin connectors.

6. The expandable fixture of claim 1, the telescoping segments further comprising a first intermediate segment and a second intermediate segment, where the central segment is slidably engaged with the first intermediate segment, and the first intermediate segment is slidably engaged with the first end segment, where the central segment is slidably engaged with the second intermediate segment, and the second intermediate segment is slidably engaged with the second end segment.

7. The expandable fixture of claim 6, the central segment sliding within the first intermediate segment and the first intermediate segment sliding within the first end segment, and the central segment sliding within the second intermediate segment and the second intermediate segment sliding within the second end segment.

8. The expandable fixture of claim 1 further comprising a plurality of correlating stop flanges to prevent the telescoping segments from being disengaged from one another.

9. The expandable fixture of claim 8, the stop flanges comprising a lip on each of the telescoping segments, each lip engaging a lip on another of the telescoping segments in a fully extended configuration.

10. The expandable fixture of claim 1 further comprising electrical ballast, the electrical ballast being in electrical connection to the lamp connector and providing a stable current for one lamp type.

11. The expandable fixture of claim 10, the electrical ballast being housed within the telescoping segments.

12. The expandable fixture of claim 1 further comprising electrical ballast, the electrical ballast being in electrical connection to the lamp connector and providing a stable current for more than one lamp type.

13. The expandable fixture of claim 12, the electrical ballast being located within the telescoping segments.

14. The expandable fixture of claim 1 further comprising a locking mechanism to fix the expandable fixture at an adjusted length.

15. The expandable fixture of claim 14, the locking mechanism comprising one or more setscrews to connect a sidewall of one of the telescoping segments to a sidewall of another of the telescoping segments.

16. An extendable fixture for a linear lamp, the extendable fixture comprising:

(a) nested segments elongatable along a longitudinal axis of the extendable fixture, the nested segments having a closed, polygonal cross-section and comprising:

(i) a first end segment;

(ii) a central segment having a first end and a second end; and (iii) a second end segment;

where the first end segment is slidably engaged with the first end of the central segment, where the second end segment is slidably engaged with the second end of the central segment, each of the first end segment and the second end segment having a top surface, the top surface of the first end segment being equidistant from the longitudinal axis as the top surface of the second end segment; and (b) a lamp connector connected to the top surface of the first end segment or the top surface of the second end segment, the lamp connector located to permit connection of a lamp to the extendable fixture in a direction parallel to the longitudinal axis of the extendable fixture;

where the combination of the nested segments and the lamp connector provides a lamp fixture that is linearly extendable to accommodate a variety of linear lamp lengths.

17. A linearly expandable fixture for a variety of linear lamp types, the expandable fixture comprising:

(a) overlapping, nested segments defining a longitudinal axis of the expandable fixture, the nested segments having a closed, polygonal cross-section and comprising:

(i) a first end segment;

(ii) a central segment;

(iii) a plurality of first intermediate segments;

(iv) a second end segment; and (v) a plurality of second intermediate segments;

where the first end segment is slidably engaged with one of the plurality of first intermediate segments, another one of the plurality of first intermediate segments is slidably engaged with the central segment, and each of the plurality of first intermediate segments is slidably engaged with another of the plurality of first intermediate segments, where the second end segment is slidably engaged with one of the plurality of second intermediate segments, another one of the plurality of second intermediate segments is slidably engaged with the central segment, and each of the plurality of second intermediate segments is slidably engaged with another of the plurality of second intermediate segments, where each of the first end segment and the second end segment has a top surface, the top surface of the first end segment being equidistant from the longitudinal axis as the top surface of the second end segment; and (b) a lamp connector connected to the top surface of the first end segment or the top surface of the second end segment, the lamp connector located to permit connection of a lamp to the expandable fixture in a direction parallel to the longitudinal axis of the expandable fixture.

18. An expandable fixture for a plurality of fluorescent lamp lengths, the expandable fixture comprising:

(a) interlocking, telescoping segments defining a longitudinal axis of the expandable fixture, the telescoping segments having a closed, rectangular cross-section and comprising:

(i) a first end segment and a second end segment, each of the first end segment and the second end segment having a top surface, the top surface of the first end segment being equidistant from the longitudinal axis as the top surface of the second end segment;

(ii) a central segment;

(iii) a first intermediate segment and a second intermediate segment; and (iv) a plurality of correlating stop flanges to prevent the telescoping segments from being disengaged from one another;

where the first end segment is slidably engaged with the first intermediate segment, the first intermediate segment sliding within the first end segment, the first intermediate segment is slidably engaged with the central segment, the central segment is slidably engaged with the second intermediate segment, the central segment sliding within each of the first intermediate segment and the second intermediate segment, and the second intermediate segment is slidably engaged with the second end segment, the second intermediate segment sliding within the second end segment;

(b) a pair of lamp sockets connected to the expandable fixture, one on the top surface of the first end segment and one on the top surface of the second end segment, the pair of lamp sockets being located to permit connection of a linear fluorescent lamp between the pair of lamp sockets and parallel to the longitudinal axis of the expandable fixture; and (c) electrical ballast within the telescoping segments, the electrical ballast being in electrical connection with the lamp sockets and providing a stable current for the fluorescent lamp.

* * * * *